US011708981B2

(12) United States Patent
Clara et al.

(10) Patent No.: US 11,708,981 B2
(45) Date of Patent: Jul. 25, 2023

(54) HIGH-PRESSURE RE-START CONTROL ALGORITHM FOR MICROCHANNEL CONDENSER WITH REHEAT COIL

(71) Applicant: Lennox Industries Inc., Richardson, TX (US)

(72) Inventors: Colin Clara, Frisco, TX (US); Eric Perez, Hickory Creek, TX (US); Walter E. Davis, II, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 57 days.

(21) Appl. No.: 17/208,795

(22) Filed: Mar. 22, 2021

(65) Prior Publication Data

US 2021/0207823 A1 Jul. 8, 2021

Related U.S. Application Data

(62) Division of application No. 15/362,316, filed on Nov. 28, 2016, now Pat. No. 11,022,331.

(51) Int. Cl.

| | |
|---|---|
| ***F24F 3/153*** | (2006.01) |
| ***F25B 41/20*** | (2021.01) |
| ***F24F 3/14*** | (2006.01) |

(52) U.S. Cl.

CPC ..... *F24F 3/153* (2013.01); *F25B 41/20* (2021.01); *F24F 3/1405* (2013.01); *F25B 2600/17* (2013.01)

(58) Field of Classification Search

CPC . F24F 3/153; F24F 3/1405; F25B 2700/1931; F25B 2700/195; F25B 2600/17; F25B 41/04; F25B 41/046; F25B 2500/07; F25B 2313/021; F25B 2313/0212; F25B 2500/26

See application file for complete search history.

(56) References Cited

U.S. PATENT DOCUMENTS

| | | | |
|---|---|---|---|
| 7,980,087 | B2 | 7/2011 | Anderson et al. |
| 2006/0086115 | A1 | 4/2006 | Weber et al. |
| 2008/0098756 | A1 | 5/2008 | Uselton |
| 2011/0030397 | A1 | 2/2011 | Taras et al. |
| 2015/0052937 | A1 | 2/2015 | Hung |
| 2018/0149375 | A1 | 5/2018 | Clara et al. |
| 2021/0036642 | A1 | 2/2021 | Sandoval |

*Primary Examiner* — Tavia Sullens

(74) *Attorney, Agent, or Firm* — Baker Botts L.L.P.

(57) ABSTRACT

An HVAC system with a reheat coil is described, the system includes a compressor, a micro-channel condenser and an evaporator. A reversing valve is connected to the compressor, the micro-channel condenser and the reheat coil. The reversing valve is used to direct the refrigerant from the compressor to the micro-channel condenser in a normal mode, and to direct the refrigerant from the compressor to the reheat coil in a reheat mode. The reversing valve can be switched from normal mode to reheat mode when a high pressure condition is detected at an input to the micro-channel condenser, and switched back from reheat mode to normal mode when the high pressure condition has resolved or an amount of time has passed. In the normal mode the refrigerant is returned from the reheat coil into a refrigerant line between the evaporator and the compressor through a restrictor.

13 Claims, 6 Drawing Sheets

HIGH-PRESSURE RE-START CONTROL ALGORITHM FOR MICROCHANNEL CONDENSER WITH REHEAT COIL

CROSS-REFERENCE TO RELATED APPLICATIONS

This application is a divisional of U.S. patent application Ser. No. 15/362,316 filed Nov. 28, 2016, by Colin Clara et al., and entitled "HIGH-PRESSURE RE-START CONTROL ALGORITHM FOR MICROCHANNEL CONDENSER WITH REHEAT COIL," which is incorporated herein by reference.

TECHNICAL FIELD

The present disclosure is directed to heating, ventilation and air conditioning (HVAC) systems, and more particularly to HVAC systems with micro-channel condensers and reheat coils.

BACKGROUND OF THE INVENTION

Typical HVAC systems, such as system 10 is shown in FIG. 1, include a compressor 11, condenser 12, evaporator 13, and expansion valve 14 to produce cooled and dehumidified air for indoor spaces. The refrigerant comes into the compressor 11 as a low-pressure gas, it is compressed and then moves out of the compressor 11 as a high-pressure gas.

The gas then flows to the condenser 12 where the gas condenses to a liquid and gives off its heat to the outside air. The liquid then moves to the expansion valve 14 under high pressure. The expansion valve 14 restricts the flow of the fluid, and lowers its pressure as it leaves the expansion valve 14. The low-pressure two phase fluid then moves to the evaporator 13, where heat from the inside air is absorbed and changes it to a gas. As a hot low-pressure gas, the refrigerant moves to the compressor 11 where the entire cycle is repeated.

In certain instances, dehumidification may be desirable without additional cooling, such as when the indoor air temperature is at or near its desired set point but there is excess humidity. In such instances, a reheat coil 15 can be used to control the temperature of the conditioned air. The warm high pressure gas from compressor 11 is directed to reheat coil 15 by reheat valve 16. Cooled, dehumidified air from the evaporator 13 is passed across the reheat coil 15 where it is warmed by the gas from compressor 11. The refrigerant from the reheat coil is then directed to the condenser 12 and the normal cycle is resumed. Check valve 17 prevents back flow of refrigerant into the reheat coil.

Typically the coils in the system 10 have been standard tube and fin designs, with all of the coils having similar properties throughout the system. However, there has been a move to use micro-channel coils in condensers. Typical micro-channel coils are constructed of parallel flow aluminum tubes that are mechanically brazed to enhanced aluminum fins, resulting in better heat transfer and a smaller, lighter, corrosion resistant coil. Micro-channel coils are smaller, more efficient and use less refrigerant than standard tube and fin coils.

Due to refrigerant capacity constraints with micro-channel coils, they have not been used in systems that include reheat coils. Further, in HVAC systems that include micro-channel condensers, the buildup of refrigerant pressure in HVAC systems is a common problem. The problem can be particularly acute in systems with micro-channel condensers because micro-channel condensers may be sensitive to certain operating conditions. For example, when ambient temperatures (e.g., temperatures proximate a condenser or temperature proximate a condenser fan) are high, the pressure in the micro-channel condenser may become elevated due to the refrigerant capacity size difference between the micro-channel condenser and the evaporator. The high pressures (e.g., pressures greater than approximately 615 psi, in some embodiments) may cause mechanical failure, including pre-failure events, such as excessive wear on parts. High pressures may also trip safety systems designed to prevent overpressure.

A particular problem can occur upon startup of an HVAC system. Refrigerant may not be evenly/properly distributed within the system, leading to refrigerant and/or pressure imbalances, particularly high pressures at the input of the micro-channel condenser, commonly known as slugging.

BRIEF SUMMARY OF THE INVENTION

In a preferred embodiment, a system for alleviating high pressure conditions associated with micro-channel condensers is described. The system includes a compressor operable to compress a refrigerant, a micro-channel condenser operable to remove heat from the refrigerant, and an expansion valve fluidly connected to the micro-channel condenser. An evaporator is fluidly connected to the expansion valve and to an input of the compressor. The system further includes a reheat coil with an output of the reheat coil fluidly connected to the condenser. A valve is connected to the compressor, the micro-channel condenser and the reheat coil, the valve directing the refrigerant from the compressor to the micro-channel condenser in a normal mode, and the valve directing the refrigerant from the compressor to the reheat coil in a reheat mode. In normal mode refrigerant is returned from the reheat coil into a refrigerant line between the evaporator and the compressor through a restrictor.

In another preferred embodiment a method of alleviating high pressure conditions associated with micro-channel condensers is described. The method senses a high pressure condition in refrigerant from a compressor at an input to a micro-channel condenser, and uses a valve to redirect refrigerant from the compressor into a reheat coil. The system operates in a reheat mode until a desired amount of refrigerant is held by the reheat coil. Then the valve is used to return the refrigerant from the compressor back to the input to the micro-channel condenser. The system then provides a path from the reheat coil to a low pressure refrigerant line flowing to the compressor.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
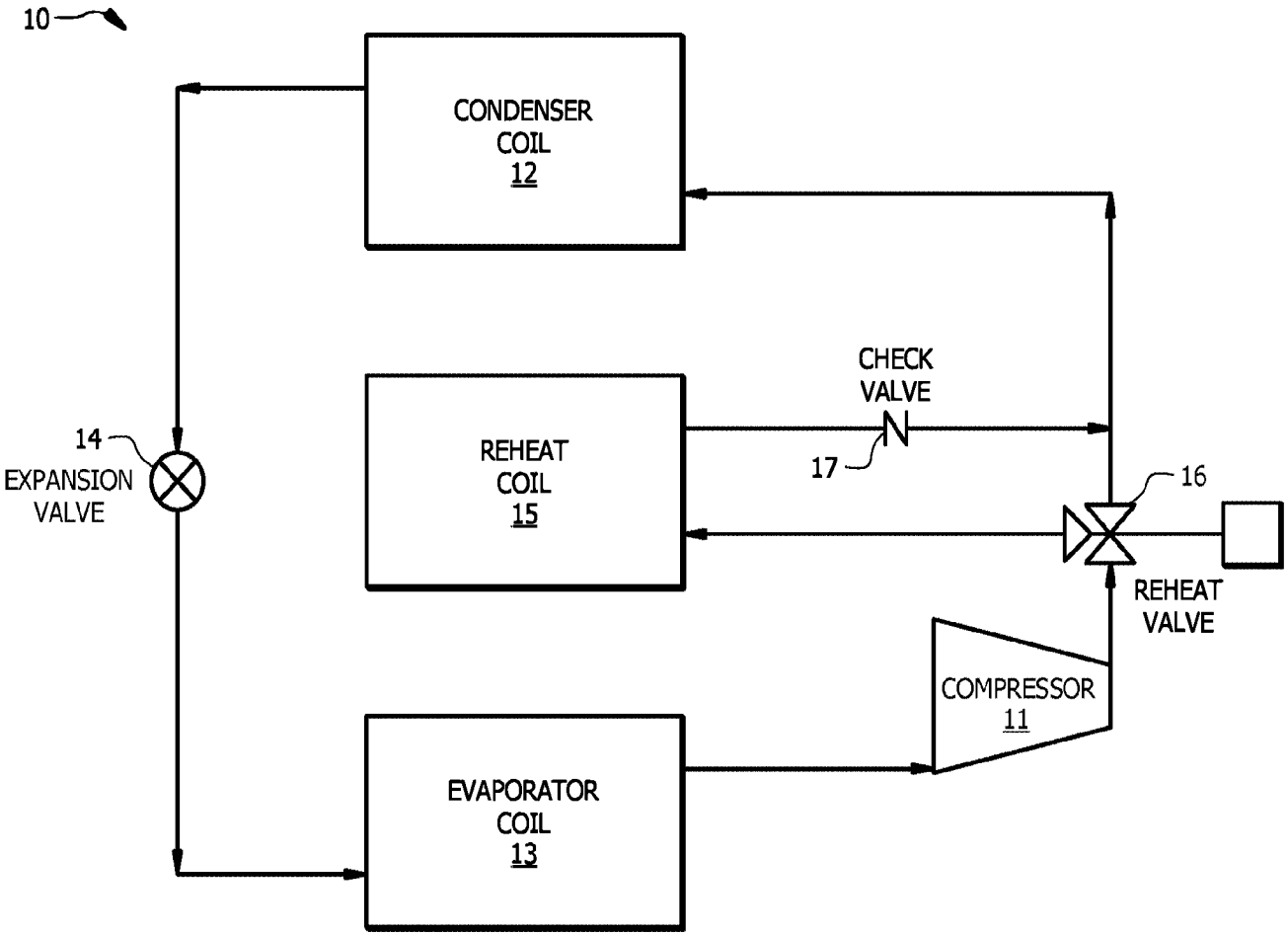
FIG. 1 (Prior Art)
FIG. 1 is a block system diagram showing an embodiment of a prior art HVAC system with a reheat/dehumidifying coil.
Figure 2:
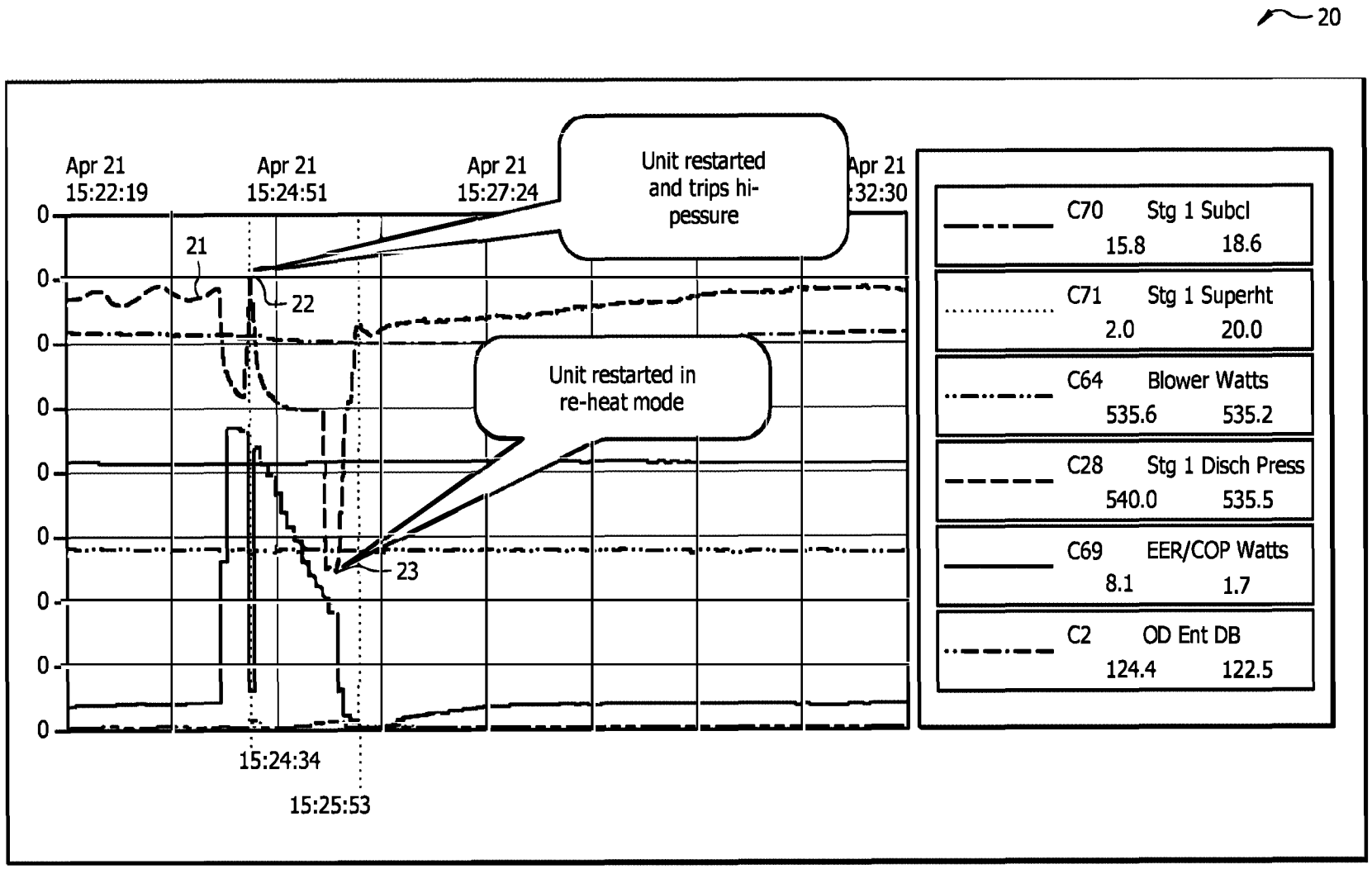
FIG. 2 is a graph showing an example of operating pressures in an HVAC system according to the concepts described herein.

As described, one issue that can occur in HVAC systems using a reheat coil and micro-channel condenser is "slugging", or overpressure at the condenser input, during start up, particularly during high ambient and overcharge conditions. This is caused by the inability of the micro-channel condenser to accept all of the high pressure refrigerant from compressor as the system progresses toward steady state operation. The small tubing and low volume of the micro-channel condenser cannot accept the refrigerant fast enough and a high pressure spike appears at the input. This can be seen by referring now to FIG. 2. Graph 20 of FIG. 2 shows the pressure 21 of the refrigerant at the micro-channel condenser input for a preferred embodiment of HVAC system according to the concepts described herein. Pressure spike 22 occurs at system start up and exceeds a trip pressure for the system resulting in the system shutting down to avoid potentially dangerous pressures.

Figure 3:
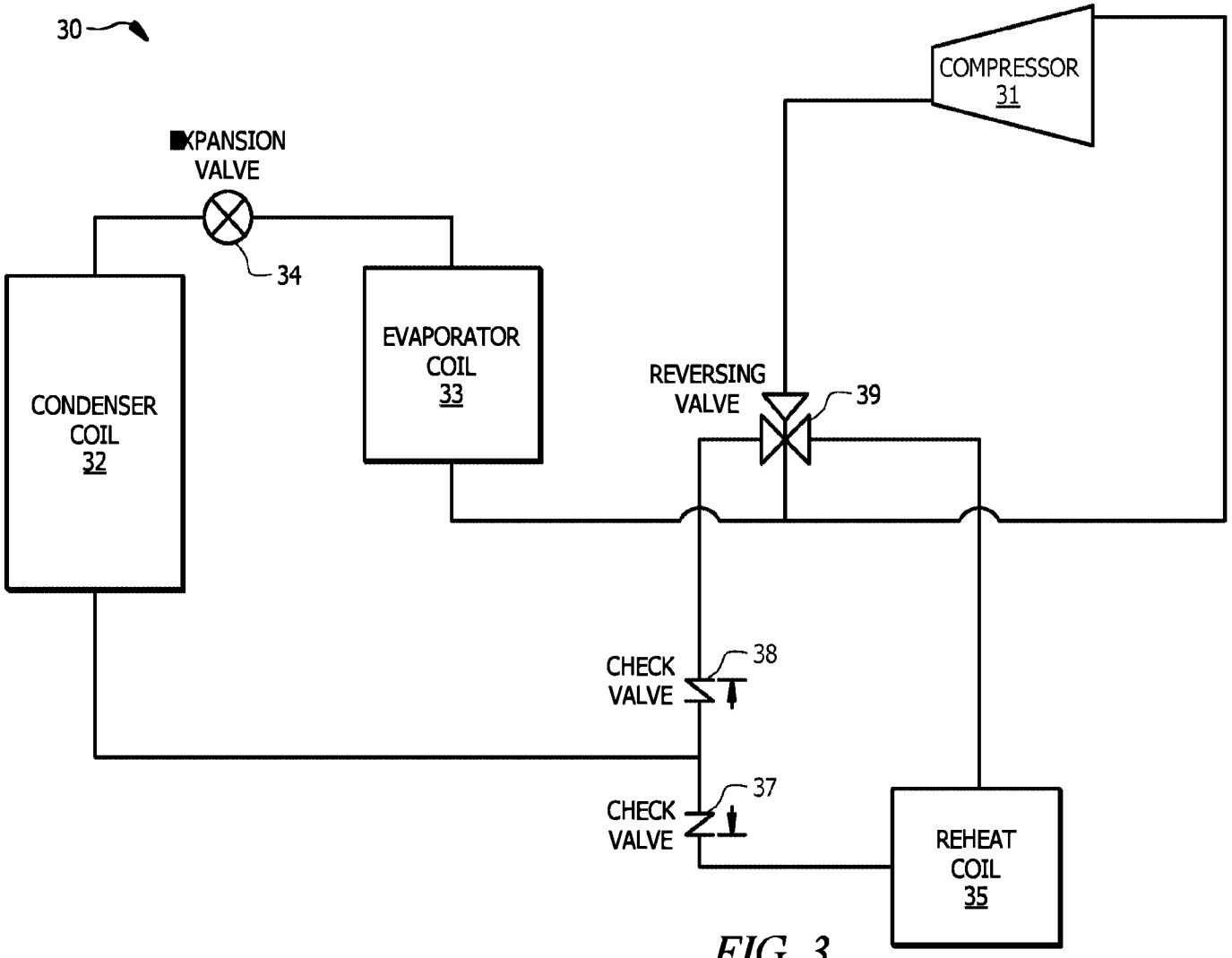
FIG. 3 is a system diagram showing an embodiment of an HVAC system incorporating the concepts described herein.

According to the concepts described herein and embodiments of an HVAC system as described herein, such as the system shown in FIG. 3, the system may be restarted in reheat mode. As described in greater detail below, starting in reheat mode allows the reheat coil to act as a reservoir for excess refrigerant, thereby reducing the pressure at the micro-channel condenser input as shown by pressure 23 in graph 20. After being re-started in reheat mode the system can be switched to normal operation, and as will be described with reference to FIGS. 3-5, the excess refrigerant stored in the reheat coil will be slowly returned to the system for optimal efficiency.

Referring now to FIG. 3, a preferred embodiment of an HVAC system 30, according to the concepts described herein is shown. System 30 operates as a traditional HVAC system with a reheat coil with the mode of operation determined by reversing valve 39. With the reversing valve 39 in normal mode, compressor 31 sends refrigerant through the left branch of the valve to condenser coil 32 through check valve 38. Check valve 37 prevents refrigerant from entering the output of reheat coil 35. As in typical systems, the refrigerant then passes from condenser coil 32 through expansion valve 34 to evaporator coil 33 where it is then returned to compressor 31.

In reheat mode, system 30 has reversing valve 39 positioned to direct refrigerant through the right most branch into reheat coil 35. From reheat coil 35 the refrigerant passes through check valve 37 and into condenser coil 32. Check valve 38 prevents the refrigerant from passing into reversing valve 39. The refrigerant then passes through expansion valve 34 and evaporator 33 before returning to compressor 31. Further operation of reversing valve 39 will be described with respect to FIGS. 4 and 5.

Figure 4A:
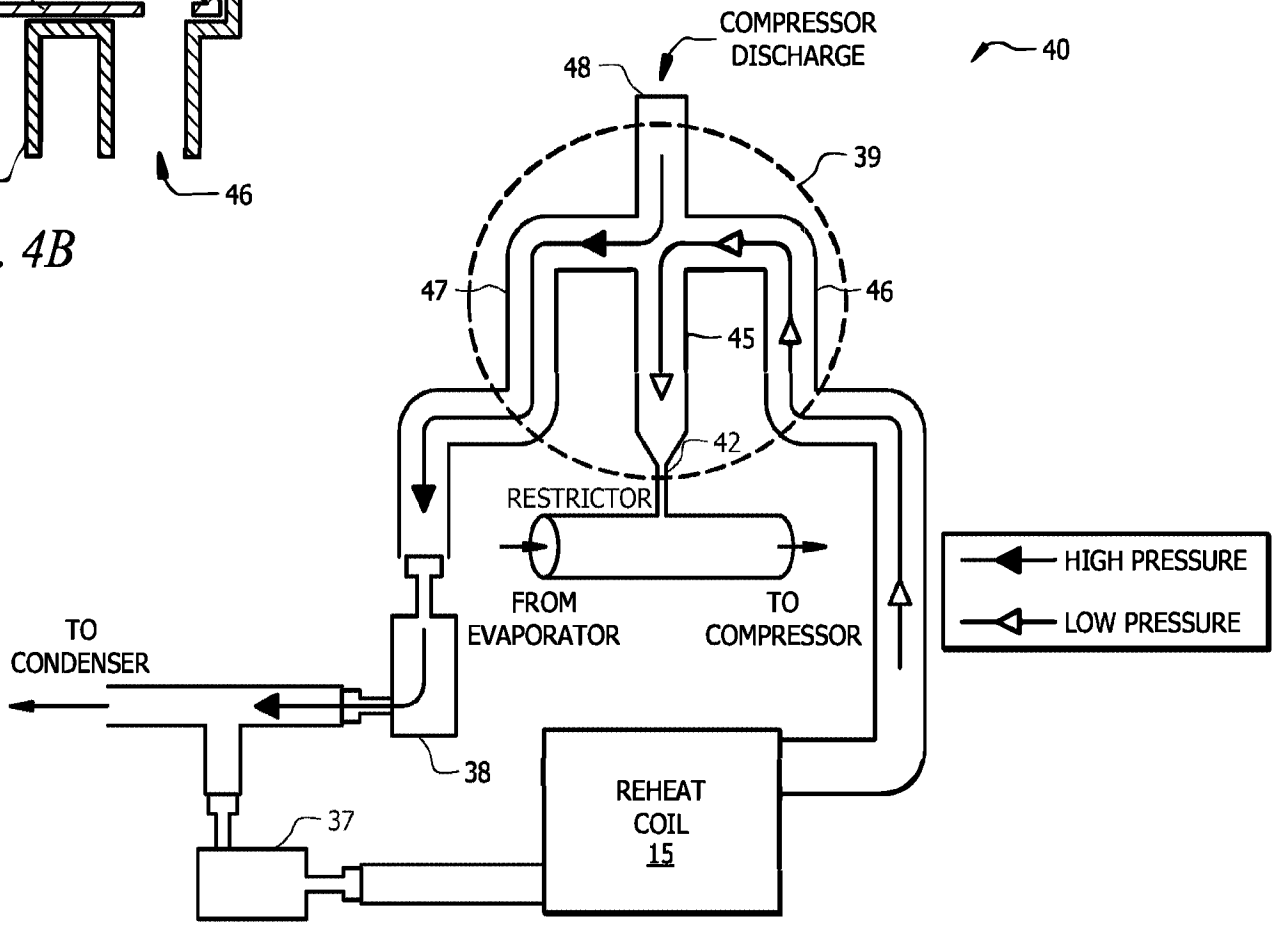
FIG. 4A is an embodiment of an operational flow diagram of the HVAC system of FIG. 3 in normal mode.
Figure 4B:
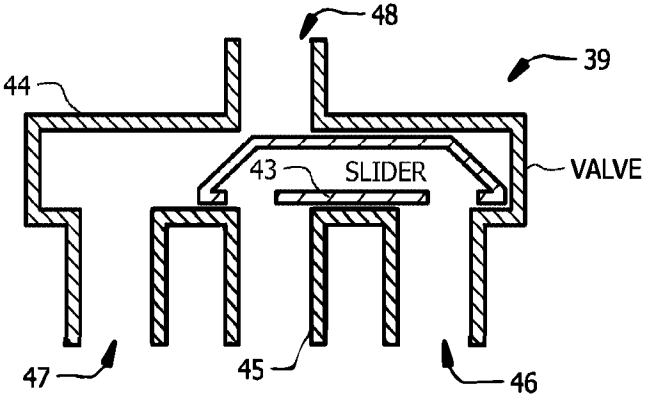
FIG. 4B is a diagram of an embodiment of the reversing valve shown in FIG. 4A.

Referring now to FIG. 4A, a preferred embodiment of the operation of reversing valve 39 is shown. Reversing valve 39 operates to direct fluid from input 48 to either left branch 47 or right branch 46. Fluid from branch not fluidly connected to the input 48 is directed down middle branch 45. An embodiment of a valve having these characteristics is shown with reference to FIG. 4B. In FIG. 4B, valve 39 includes body 44 and slider 43. Slider 43 can be positioned within body 44 to direct fluid from input 48 to left branch 47 when slider is positioned to the right as shown. The other two branches, in this case right branch 46 and center branch 45 are fluidly connected through slider 43. Moving the slider 43 to a left position would then fluidly connect input 48 and right branch 46 while simultaneously fluidly connecting left branch 47 and center branch 45. While a specific type of valve is described in FIG. 4*b*, any type of valve having the same or similar characteristics can be used within the scope of the concepts described herein. Also, while reference is made to right, left and middle branches, these terms are for illustrating the operation valve 39 and are not meant to be limiting. The individual pieces of the valve may be in any physical orientation as long as the operation is consistent with that described herein. Further, while valve 39 has been described as operating in a binary fashion, that is either "left" or "right", valve 39 can also be operated by modulating the position of the valve. The amount of refrigerant flowing to the condenser, for example, through valve 39 can be controlled by repeatedly switching the position of slider 43 to reduce the refrigerant flow from full to some desired percentage. The desired percentage can be based on pressure readings, timing, or other measurements or factors.

Returning to FIG. 4A, reversing valve 39 is positioned for the system to operate in "normal" mode without the reheat feature. The slider, not shown, is positioned to direct compressor discharge fluid from input 48 to left branch 47 which is connected to the condenser through check valve 38. In this mode, system 40 operates as described above with fluid from the compressor flowing to the condenser, the expansion valve and the evaporator before returning to the compressor. As can be seen, this mode of valve 39 also fluidly connects the reheat coil to the line between the evaporator and the compressor through restrictor 42. This fluid connection allows fluid in the reheat coil to drain back into the normal mode fluid path at a speed determined by the size of the restrictor 42.

Figure 5:
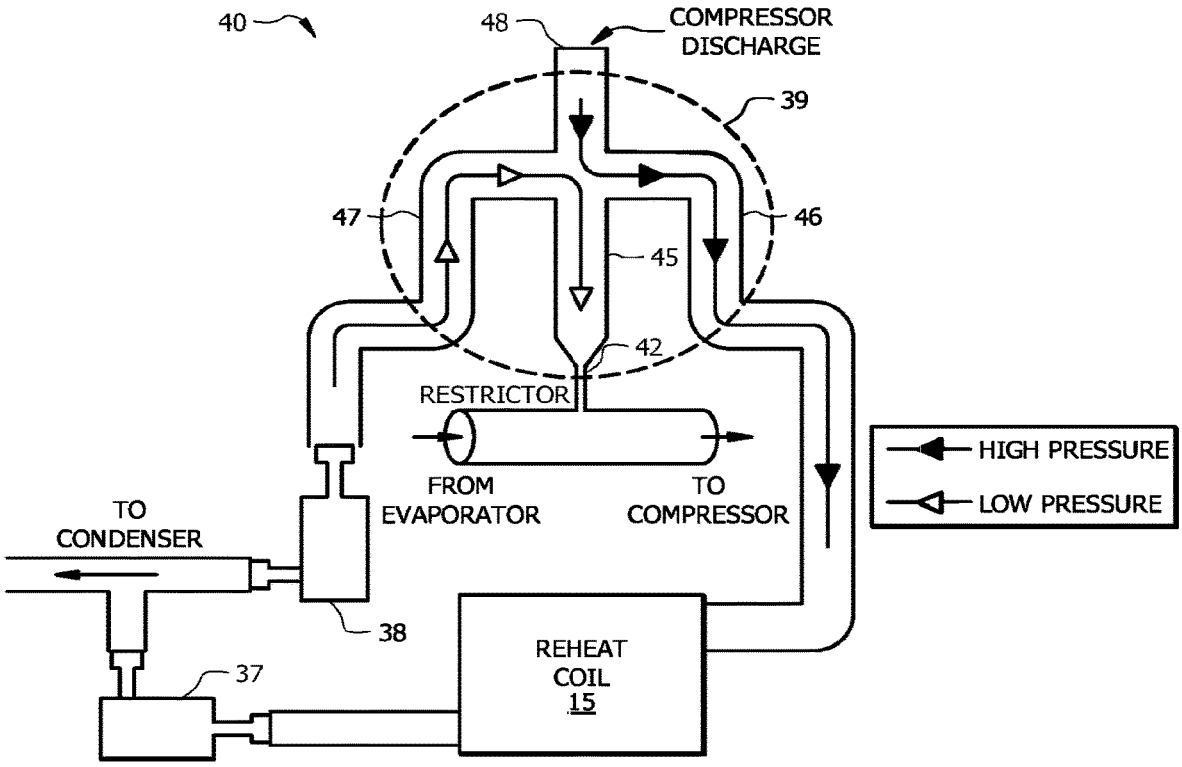
FIG. 5 is an embodiment of an operational flow diagram of the HVAC system of FIG. 3 in reheat mode.

Referring now to FIG. 5, the preferred operation of system 40 with reversing valve 39 positioned in reheat mode is shown. The slider, not shown, is positioned to direct compressor discharge fluid from input 48 to right branch 46 which is connected to the reheat coil 15. In this mode, system 40 operates in reheat mode as described with fluid from the compressor flowing to the reheat coil 15 then through check valve 37 on to the condenser, the expansion valve and the evaporator before returning to the compressor. As can be seen, this mode of valve 39 also fluidly connects the left branch of valve 19 to the line between the evaporator and the compressor through restrictor 42.

With reference to FIGS. 3-5 describing a system according to the concepts described herein, it can be seen how reheat coil can be used as a reservoir to remove refrigerant from the system during high pressure events at the input to the micro-channel condenser, such as cold slug starts. If a high pressure event during normal operation is detected, the system can use valve 39 to temporarily enter reheat mode and direct refrigerant into reheat coil 15, removing that volume of refrigerant temporarily from the system at which point the valve 39 is used to return to normal mode. The removal of refrigerant into reheat coil 15 results in a lower refrigerant volume in normal mode, thereby relieving high pressure issues with the micro-channel condenser. The valve 39 also allows refrigerant to flow from the reheat coil back into the system during normal operation to restore optimal efficiency to the system.

Figure 6:
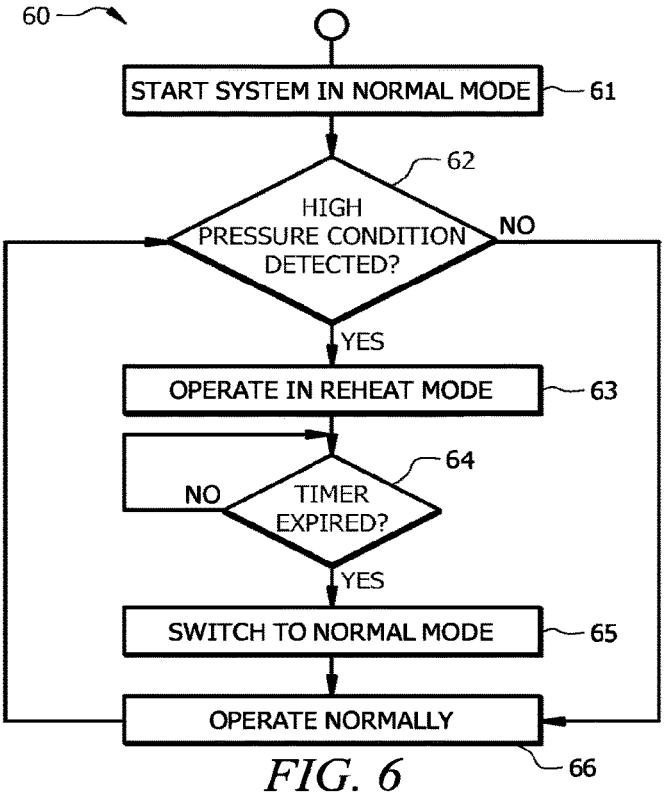
FIG. 6 is a flow chart showing an embodiment of a method of operating an HVAC system according to the concepts described herein.

Referring now to FIG. 6, a preferred embodiment of a method of operation of an HVAC system according to the concepts described herein is shown. Method 60 begins with the HVAC system starting in normal mode in process 61. If a high pressure condition is detected in process 62 the method proceeds to process 63, otherwise the system continues to operate normally. In process 63 the system is switched to reheat mode. In process 64, a timer or other mechanism such as any of a variety of sensor inputs is used to run the system in reheat mode until a desired quantity of refrigerant is being held in the reheat coil. The system is then switched back to normal mode in process 65 and operated normally as shown in process 66. As described the refrigerant in the reheat coil will then return to the normal operational mode through the restrictor shown in FIGS. 3-5.

Figure 7:
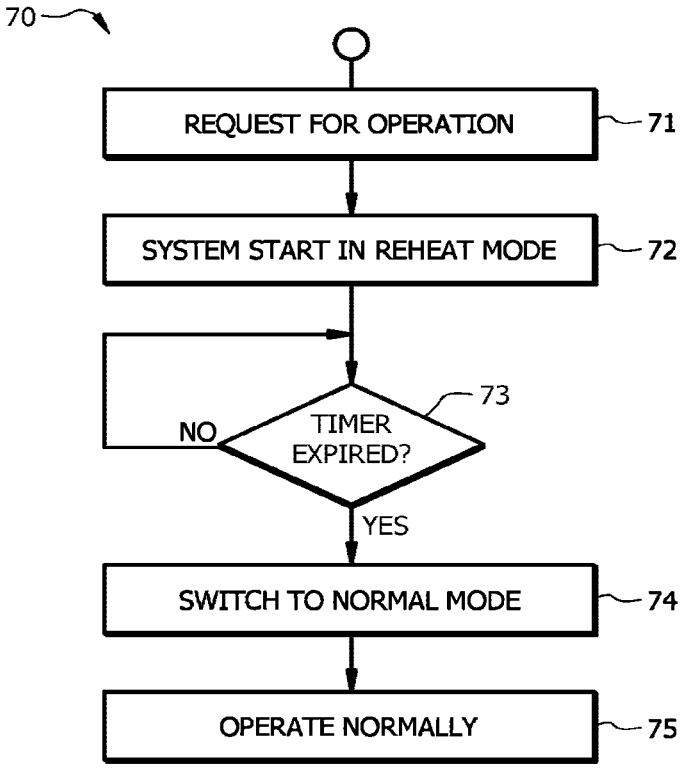
FIG. 7 is a flow chart showing an embodiment of an alternative method of operating an HVAC system according to the concepts described herein.

Referring now to FIG. 7, a preferred embodiment of an alternative method of operation of an HVAC system according to the concepts described herein is shown. The method of FIG. 7 acts to prevent high pressure conditions at the input to a micro-channel condenser by always starting operation in reheat mode and then switching after a predetermined amount of time to normal operation. Method 70 begins with the HVAC system receiving a request for operation 71. In process 72 the system is started in reheat mode. In process 73, a timer or other mechanism such as any of a variety of sensor inputs is used to run the system in reheat mode until a desired amount of time has passed or a system conditions is met as measured by one or more sensors. The system is then switched to normal mode in process 74 and operated normally as shown by process 75. As described the refrigerant in the reheat coil will then return to the normal operational mode through the restrictor shown in FIGS. 3-5. As described, the reference to a timer in process 73 (and in process 64) can refer to an actual timer or to the time that elapses until the monitoring of one or more system conditions shows that the condition or conditions meet a predetermined threshold or value.

While the present invention has been described with reference to a system with a single compressor and single condenser, the concepts described herein are applicable to systems with any number of compressors and condensers operating in parallel.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of controlling a heating, ventilation and air conditioning (HVAC) system, the method comprising:

receiving a request to start operation of the HVAC system;

using a valve to direct refrigerant from a compressor through a second branch of the valve into a reheat coil at startup, thereby causing the HVAC system to operate in a reheat mode, wherein the valve comprises a valve input connected to the compressor, a first branch connected to a micro-channel condenser, the second branch connected to the reheat coil, and a third branch connected to a low pressure refrigerant line, wherein the low pressure refrigerant line directly connects an evaporator to the compressor;

operating in the reheat mode for a predetermined amount of time to prevent high pressure conditions at an input to the micro-channel condenser and after operating in the reheat mode for the predetermined amount of time:

using the valve, in a normal mode, to direct the refrigerant from the compressor through the first branch of the valve to the input to the micro-channel condenser; and using the valve, in the normal mode, to direct the refrigerant from the reheat coil through the second branch of the valve, out of the third branch of the valve, and to the low pressure refrigerant line through a restrictor located between the third branch of the valve and the low pressure refrigerant line directly connecting the evaporator to the compressor.

2. The method of claim 1, wherein the compressor, the evaporator, the micro-channel condenser, the reheat coil and the valve are part of the HVAC system, the HVAC system further comprising an expansion valve fluidly connected to the micro-channel condenser.

3. The method of claim 1, further comprising directing the refrigerant from the compressor to the micro-channel condenser in the normal mode of operation.

4. The method of claim 1, further comprising:

monitoring one or more system conditions; and switching from the reheat mode to the normal mode when either at least one of the one or more monitored system conditions meets a predetermined threshold or value, or the predetermined amount of time has elapsed.

5. The method of claim 1, wherein the refrigerant is directed into the reheat coil to prevent the high-pressure conditions by temporarily reducing an amount of the refrigerant at the input to the micro-channel condenser.

6. The method of claim 1, further comprising modulating the valve to decrease an amount of the refrigerant directed to the micro-channel condenser.

7. A heating, ventilation and air conditioning system comprising:

a valve comprising a valve input connected to a compressor, a first branch connected to a micro-channel condenser, a second branch connected to a reheat coil, and a third branch connected to a refrigerant line through a restrictor, wherein the refrigerant line directly connects an evaporator to the compressor, wherein the valve is configured to:

when the system is operated in a reheat mode:

direct refrigerant from the compressor into the valve input, out of the second branch of the valve and into the reheat coil in conjunction with startup of the system, wherein the system is configured to operate in the reheat mode for a predetermined amount of time to prevent high pressure conditions at an input to the micro-channel condenser; and when the system is operated in a normal mode:

direct the refrigerant from the compressor into the valve input, out of the first branch of the valve, and to the input to the micro-channel condenser;

direct the refrigerant from the reheat coil through the second branch of the valve, out of a third branch of the valve, and into the refrigerant line through the restrictor, the restrictor being located between the third branch of the valve and the refrigerant line directly connecting the evaporator to the compressor.

8. The system of claim 7, further comprising an expansion valve fluidly connected to the micro-channel condenser.

9. The system of claim 7, wherein the valve is configured to switch from the normal mode to the reheat mode when the high-pressure conditions are detected at the input to the micro-channel condenser.

10. The system of claim 7, wherein the system is configured to monitor one or more system conditions, and the valve is configured to switch from the reheat mode to the normal mode when either at least one of the one or more monitored system conditions meets a predetermined threshold or value, or the predetermined amount of time has elapsed.

11. The system of claim 7, wherein the refrigerant is directed into the reheat coil to prevent the high pressure condition by temporarily reducing an amount of the refrigerant at the input to the micro-channel condenser.

12. The system of claim 7, wherein a speed of the refrigerant returned to the low pressure refrigerant line while operating in the normal mode is determined by a size of the restrictor.

13. The system of claim 7, wherein the valve is configured to be modulated to decrease an amount of the refrigerant directed to the micro-channel condenser.

* * * * *